US008808526B2

(12) United States Patent
Faure et al.

(10) Patent No.: US 8,808,526 B2
(45) Date of Patent: Aug. 19, 2014

(54) PROCESS FOR CHANGING A SPENT ANODE

(75) Inventors: Maxime Faure, Grenoble (FR); Christian Cloue, Gardanne (FR); John MacLeod, Fort William (GB)

(73) Assignee: Rio Tinto Alcan International Limited, Montreal, Quebec (CA)

( * ) Notice: Subject to any disclaimer, the term of this patent is extended or adjusted under 35 U.S.C. 154(b) by 40 days.

(21) Appl. No.: 13/513,483

(22) PCT Filed: Oct. 19, 2010

(86) PCT No.: PCT/FR2010/000691

§ 371 (c)(1), (2), (4) Date: Jun. 1, 2012

(87) PCT Pub. No.: WO2011/067477

PCT Pub. Date: Jun. 9, 2011

(65) Prior Publication Data

US 2012/0246923 A1 Oct. 4, 2012

(30) Foreign Application Priority Data

Dec. 2, 2009 (FR) ..... 09 05813

(51) Int. Cl.
*C25C 3/22* (2006.01)

(52) U.S. Cl.
USPC ..... 205/391; 205/392; 204/279

(58) Field of Classification Search
CPC ..... C25C 3/06; C25C 3/22; C25C 7/06
USPC ..... 29/825, 623.1; 204/279, 245–247; 205/43, 81, 374, 389, 391–392; 429/416, 421, 443, 492
See application file for complete search history.

(56) References Cited

U.S. PATENT DOCUMENTS

| | | | | |
|---|---|---|---|---|
| 4,269,673 | A * | 5/1981 | Clark | 205/374 |
| 5,961,812 | A | 10/1999 | Bouzat et al. | |
| 6,161,307 | A | 12/2000 | Bourgeois et al. | |
| 6,767,444 | B1 * | 7/2004 | Miller et al. | 205/43 |
| 7,001,497 | B2 * | 2/2006 | Gagne et al. | 205/81 |
| 8,252,156 | B2 * | 8/2012 | Dumont et al. | 204/279 |
| 2012/0246923 | A1 * | 10/2012 | Faure et al. | 29/825 |

FOREIGN PATENT DOCUMENTS

| | | | |
|---|---|---|---|
| DE | 4221882 | A1 | 1/1994 |
| FR | 2754832 | A1 | 4/1998 |
| WO | 03/042618 | A1 | 5/2003 |
| WO | 2008/048844 | A1 | 4/2008 |

OTHER PUBLICATIONS

International Search Report mailed Jan. 21, 201 (PCT/FR2010/000691); ISA/EP.

* cited by examiner

*Primary Examiner* — Minh Trinh
(74) *Attorney, Agent, or Firm* — Banner & Witcoff, Ltd.

(57) ABSTRACT

The process involves pouring a smothering powder onto a spent anode placed on a support to cover it, with the aim of limiting fluorinated gas emission by the anode. The support may include a temporary tank, pre-filled with powder and provided with an opening for discharging the powder towards the anode on the support.

8 Claims, 4 Drawing Sheets

PROCESS FOR CHANGING A SPENT ANODE

The present application is a U.S. National Phase filing of International Application No. PCT/FR2010/000691, filed on Oct. 19, 2010, designating the United States of America and claiming priority to France Patent Application No. 0905813, filed Dec. 2, 2009. The present application claims priority to and the benefit of all the above-identified applications, and all the above-identified applications are incorporated by reference herein in their entireties.

FIELD OF THE INVENTION

The present invention relates to a process for changing a spent anode from an aluminum electrolysis cell, in particular including a stage of temporary storage of such a spent anode. The invention also relates to a support and a system for the temporary storage of at least one such a spent anode.

BACKGROUND OF THE INVENTION

Metallic aluminum is produced industrially by electrolysis of alumina in solution in an electrolyte bath primarily made up of cryolite, using the Hall-Héroult process. The electrolyte bath is contained in an electrolysis cell, comprising a steel container coated on the inside with refractory and/or insulating materials, and at the bottom of which a cathodic unit located.

Anodes, typically made of carbonaceous material, are partially immersed in the electrolyte bath. Each anode is provided with a metal rod designed to connect it electrically and mechanically with an anode framework that is mobile in relation to a gantry fixed above the electrolysis cell.

As the anodes are consumed by electrolysis, they must regularly be changed. For this purpose, a spent anode with its rod is detached from the anode frame and moved towards a temporary support where it is allowed to cool before being moved on to an installation in which the unconsumed carbonaceous material is recovered.

However, a spent anode from an electrolysis cell emits fluorinated gases which can be harmful for man and the environment. The emissions increase in proportion to the temperature of the anode and gradually decrease at the same time as the temperature.

For many years it has therefore been attempted to prevent fluorinated gases emitted by the spent anodes from being diffused into the environment, or at least to limit this diffusion. Various devices and processes have been imagined.

In particular, one suggested process involves placing the spent anode on its support inside a closed box designed to prevent the uncontrolled outlet of fluorinated gases. According to a first known embodiment, in particular described in document FR 2 754 832 (corresponding to US document U.S. Pat. No. 5,961,812, filed in the name of Aluminium Pechiney), the gases within the box are sucked out to a treatment unit. According to another known embodiment, in particular described in document DE 42 21 882, filed in the name of Westfalia Becorit Industrietechnik, the box includes a filter containing alumina, which is able to trap fluorinated gases.

According to a third known embodiment, presented in document WO 2008/048844 filed in the name of Alcoa, the box comprises an opening through which the anode rod passes and which is equipped with a flexible sealing element working in conjunction with said rod Another known process is described in document WO 2003/042618 filed in the name of Norsk Hydro according to which it is planned to use a storage box for the spent anode in conjunction with an extraction system.

The above mentioned processes and devices are not entirely satisfactory. It is indeed difficult, if not impossible, to obtain good sealing by means of a box, especially as the latter undergoes deformations during its lifespan, which lead to an increase in gas leaks. The means of sealing generally put forward to compensate for these problems are consumables which wear quickly and which therefore lead to additional cost. In addition, in certain configurations of the box, an in-draft moving towards the box can generate a chimney effect causing the fluorinated gases to be drawn out through the top of the box, without passing through a filtration or suction system.

Another known process described in U.S. Pat. No. 6,161,307 filed in the name of Alcan International Limited involves plunging and moving the spent anode in a fluidized alumina bath to cool the spent anode quickly and to limit the time of fluorinated gas emission. Such a process is difficult to implement and has the disadvantage of encouraging the combustion of the spent anode by a constant supply of air onto the surface of the spent anode.

In a context of overall reduction of fluorinated emissions in aluminum plants, and especially when changing anodes, the present invention aims at curing the drawbacks mentioned above, by providing a more reliable and more effective process than the processes of prior art.

BRIEF SUMMARY OF THE INVENTION

For this purpose, according to a first aspect, the invention relates to a process for changing a spent anode from an aluminum electrolysis cell including at least one anode plunged into an electrolysis bath and a bath cover covering the anode and the liquid bath, characterized in that the process includes stages consisting of:

- removing a spent anode, to which pieces of bath cover are attached, from the electrolysis bath;
- placing said spent anode on a support;
- pouring a smothering powder onto said spent anode placed on the support to cover said spent anode with the aim in particular of limiting fluorinated gas emission.

The spent anode stored on the support and covered with smothering powder can then be transported to a spent anode reprocessing plant.

The invention particularly relates to cells using pre-baked carbonaceous material anodes.

The powder covers the anode so as to:

- prevent the diffusion of fluorinated gases emitted by the spent anode and the pieces of bath cover which are attached to it, one of the properties of the smothering powder being that it provides an obstacle to this diffusion of gases;
- prevent oxygen from reaching the anode part being consumed and thereby restrict the phenomenon of anode consumption, the oxidizing agent—oxygen—being in this way withdrawn from the fire triangle which consists of the entities fuel, oxidizing agent and energy.

Also, as the smothering powder prevents water and ambient moisture from reaching the anode, the amount of fluorinated gas HF emitted by the anode is limited.

Preferably, the smothering powder does not oxidize and is not consumed at the maximum temperature to which it is subjected when the process is being implemented. As an example, the spent anode placed on the support to be covered by the powder can reach a temperature of about 950° C.

It may be thought that there also occurs at least partial vitrification of the smothering powder. The smothering powder is poured onto the anode and the pieces of bath cover which are at an intense temperature as they leave the electrolysis bath. It may be thought that at least part of the powder can change, in contact with the anode and pieces of bath cover, by vitrification, into an amorphous structure which plays a greater or lesser role in containing the anode and pieces of bath cover which are attached to it.

The powder must cover the anode—namely the top and the circumference of the carbonaceous part of the anode as well as the pieces of bath cover covering the anode—sufficient thickly to produce the smothering effect described above. As an example, the thickness of powder may be at least around 0.5 cm, and preferably at least around 2 cm. For economic reasons, it is preferable to limit the thickness of powder used.

Preferably, the powder is chosen from the group including alumina, substances comprising aluminum fluoride and/or sodium fluoride, such as cryolite, or a mixture of these. These substances are of interest in that they are available in any plant producing primary aluminum. Substances comprising silica, such as sand, which are easy to obtain and handle could also be used.

Alumina has the advantage of trapping fluorinated gases, by adsorption.

The substance containing aluminum fluoride and/or sodium fluoride has the advantage as compared with alumina of being able to form a compact and leaktight crust which prevents gases from getting through, namely oxygen from getting through to the inside, i.e. towards the anode, and fluorinated gases from getting through to the outside, i.e. to the surrounding air.

According to a preferred embodiment, the smothering powder comprises alumina, aluminum fluoride and/or sodium fluoride. Such a smothering powder may at least partly comprise some bath cover reduced to powder. For reasons of convenience, such a smothering powder, comprising alumina, aluminum fluoride and/or sodium fluoride, is obtained in particular by recycling the bath cover of the spent anode units, i.e. the solidified part of the electrolyte in the cell, located in particular along the side wall of the cell, on the free surface of the electrolyte and on the anodes. This cover is then crushed and passed through a screen to give all or part of the smothering powder used by the process according to the invention.

This bath cover is easily available in a plant producing primary aluminum. It is therefore not necessary to have recourse to products brought in especially to implement the process according to the invention, which is advantageous from the environmental standpoint and for reasons of practicality and cost.

According to another embodiment, the smothering powder at least partly comprises electrolysis bath reduced to powder after solidification.

Advantageously, the process makes provision for pre-filling with powder at least one tank associated functionally with the support and opening said tank(s) when a spent anode is present on the support.

It is additionally possible to provide means of discharging the powder onto the spent anode on the support comprising means of confinement able to limit dispersion of the powder. In this way, it is possible to cover the anode very quickly, and so obtain rapid smothering and limit fluorinated gas emissions, without this leading to a great dispersion of powder within the factory.

In one form of embodiment, the means of confinement can be arranged on the support.

In another form of embodiment, the means of confinement are arranged on a device supplying powder to the support.

According to a second aspect, the invention relates to a support for the temporary storage of at least one spent anode from an aluminum electrolysis cell, for the implementation of the process as described above, the support comprising a plate, substantially horizontal when it is placed on the ground, having at least one compartment in which an anode is to be placed.

According to a general definition, this support additionally includes at least one tank functionally associated with the plate and comprising at least:

- an opening through which a smothering powder can be introduced into said tank;
- and an opening for discharging the powder towards the anode, arranged to allow the anode to be covered by the powder so poured, with the aim of limiting fluorinated gas emission by the anode, preferably by limiting powder dispersion by fly-off.

By means of the tanks, which can be pre-filled with powder, it is possible to quickly cover the spent anode once it is placed on the support plate, and so stop fluorinated gas emissions quickly.

This support can advantageously take the form of a pallet that can be raised and moved by appropriate means. In this way, it is possible to easily move the anode to a reprocessing plant including in particular a unit for separating the anode components and then to a unit for recovering the anode materials, in particular the cover and unconsumed carbonaceous material.

The opening generally has a closing wall which may occupy a closed position, in particular when powder is introduced into the tank in order to be able to contain the awaiting powder, and which can be moved to an open position allowing the powder to be discharged when an anode is on the plate.

The support may additionally comprise means for detecting the presence of a spent anode on the plate such as a sensor and, consequently, for automatically ordering an opening device of the closing wall. In this way, the time between placing the anode on the support and discharging the powder is very short, which increases the effectiveness of the process. This opening device may for example comprise a spring and an air cushion shock absorber. The sensor used may be, for example, a heat sensor or an optical sensor.

According to one possible embodiment, the support includes at least two tanks laid out on opposite sides of the plate.

Each tank may extend over substantially the full length of the side on which it is placed. The support thereby forms a kind of receptacle closed on at least two sides, able to retain the powder poured onto the anode. It may also be considered that the support includes a tank on each side of the plate, the tanks then forming a substantially closed peripheral surface.

Each tank is advantageously arranged so that the whole length of the anode is covered with powder. In this way, for example, the powder discharge opening can extend over substantially all the length of each tank in a possible embodiment of the invention.

Preferably, at least part of the powder discharge opening is above the anode when the latter is on the plate, which makes it easier to cover the anode.

Advantageously, the tank may comprise internal means of distributing the powder such as baffles, pipes or spacers, arranged to help said tank to fill homogeneously. This configuration reduces the risks of partial covering of the anode by the powder, and limits the need for an operator to complete the spreading-out of the powder.

Provision may also be made for the tank to comprise a bottom wall tilting downwards towards the anode when the latter is on the plate, in order to help the powder to flow.

According to a third aspect, the invention relates to a system for the temporary storage of at least one spent anode from an aluminum electrolysis cell, for the implementation of the process as described above, the system including:

a support including a plate, substantially horizontal when it is placed on the ground, on which the anode is to be placed. Additionally the system according to the invention includes a device for bringing a smothering powder to the support, said device including a hopper that can be moved on an overhead traveling crane equipped with a powder discharge conduit to cover the anode with powder, with the aim of limiting fluorinated gas emission by the anode According to an advantageous provision of the system, the conduit is extended at its lower part by a cover open at the bottom which can cover the anode on the plate and form, with the support, a confinement volume for the powder.

It should be noted that the confinement volume is not necessarily leaktight but does significantly limit dispersion of the powder. For example, the cover may be substantially in the shape of a bell covering the support, the anode and its rod.

Provision may additionally be made for the system to comprise a suction conduit that communicates with said confinement volume. This makes it possible to create a slightly negative pressure inside the confinement volume to prevent the powder from escaping to the outside. Provision may additionally be made for a system to suck out the powders and/or fluorinated gases emitted by the anode.

The support pertaining to this system may comprise some of the above mentioned characteristics and in particular the powder tanks.

BRIEF DESCRIPTION OF THE DRAWINGS

Below are described, as nonrestrictive examples, several possible embodiments of the invention, with reference to the appended figures.

DETAILED DESCRIPTION OF THE INVENTION

Figure 1:
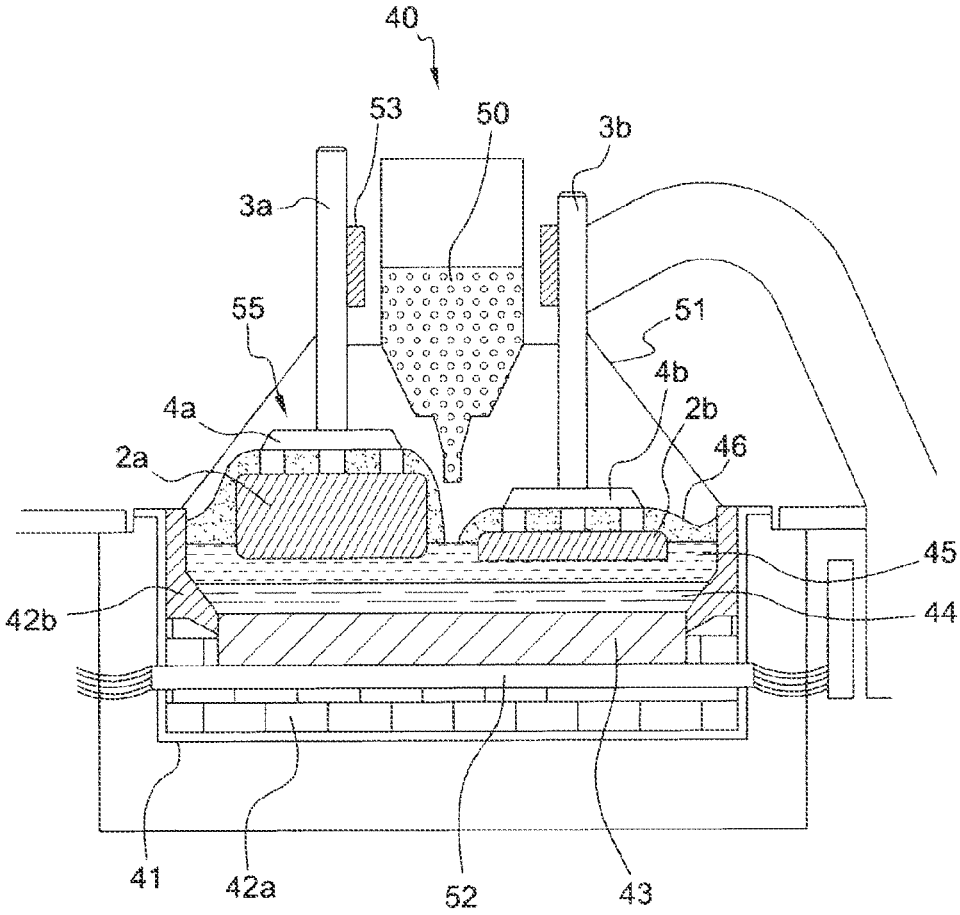
FIG. 1 illustrates an electrolysis cell in cross section.

As shown in FIG. 1, an electrolysis cell 40 typically includes a steel pot shell 41 internally lined with refractory materials 42*a*, 42*b*, cathode units made of carbonaceous material 43, anode units 55, a bearing structure 53, means 51 for recovering the effluent emitted by the cell when in operation and means 50 to supply the cell with alumina and/or AlF3. The anode units 55 typically include an anode block—or anode—2*a*, 2*b* and a rod 3*a*, 3*b*. Each rod 3*a*, 3*b* typically includes a connecting body connection or multipode 4*a*, 4*b* to fix the anode block 2*a*, 2*b*.

When in operation, the cell includes a bed of liquid aluminum 44, a bed of liquid bath 45 and a cover 46 containing solid bath and alumina. To avoid having to change all the anode units at the same time, the anode unit replacement program is generally designed in such a way that they have different degrees of wear (in FIG. 1, anode block 2*a* is less spent than anode block 2*b*). The electrolysis current circulates from the anode blocks to the cathode elements. The cathode current is recovered by conducting bars 52.

Figure 2:
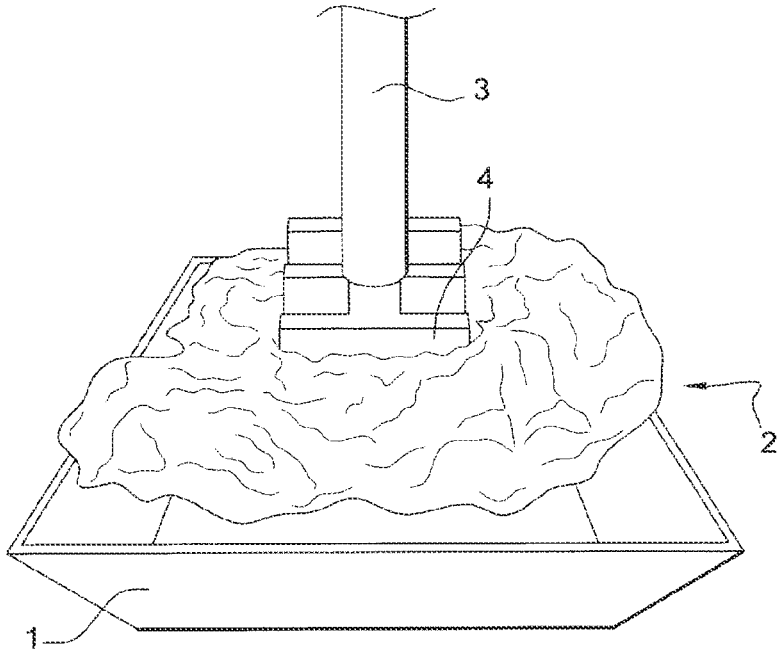
FIG. 2 is a perspective schematic view of a support according to the invention, on which is placed a spent anode provided with its rod and including a covering crust.

FIG. 2 illustrates schematically a support 1 for implementing the process, according to the invention, of temporary storage of a spent anode 2 from an aluminum electrolysis cell.

When in operation, each anode 2 is partially immersed in the bath of electrolyte in the cell (not shown). The anode is connected, via a connecting body 4, to a rod 3 which is fixed to an anode frame. When anode 2 is spent and has to be changed, it is moved and placed on support 1, generally made of metal, typically steel, which is usually located near the cell. The lower surface of the carbonaceous block of the anode rests on the horizontal bottom of the support. This operation is generally carried out using a service machine, for example a gantry or a machine on the ground. Anode 2 then has a relatively high temperature, in the region of 950° C.

Figure 3:
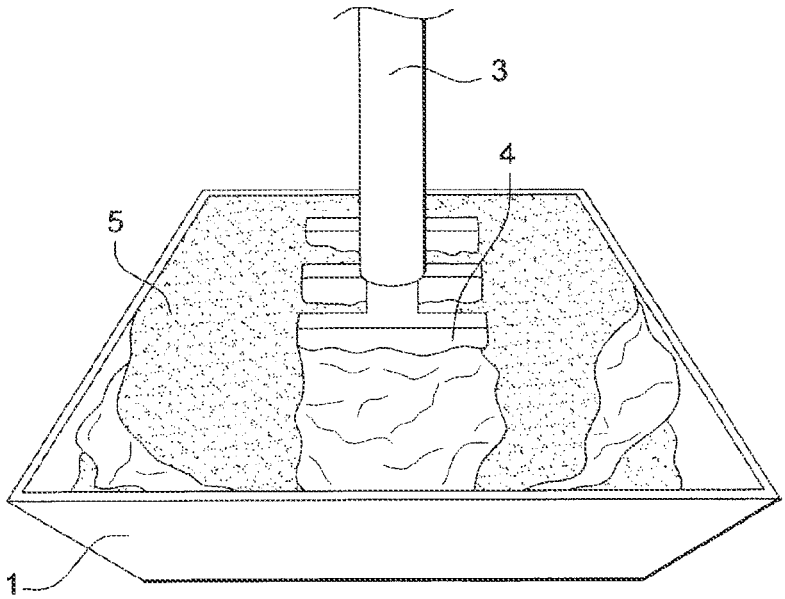
FIG. 3 is an identical view to FIG. 2, the spent anode being covered with powder.

Fluorinated gases are emitted by spent anode 2, primarily by one or more pieces of cover which remain attached to spent anode 2 when the latter is extracted from the bath. In order to limit fluorinated gas emission by the anode, the process according to the invention makes provision for covering anode 2 with a smothering powder 5. As illustrated in FIG. 3, powder 5 preferably covers all of anode 2 with the pieces of cover which are attached to it, and can therefore also partly cover the connecting body 4 connecting anode 2 to rod 3. As an example, the thickness of powder 5 can be about 4 to 5 cm.

By covering anode 2 with powder 5, the phenomenon by which anode 2 is consumed is stifled, until anode 2 cools sufficiently and fluorinated gas emissions cease or reach a sufficiently low level. Powder 5 preferably includes a fluorinated compound with alumina.

In practice, powder 5 can be obtained from bath cover which is widely available in a plant producing primary aluminum. The bath cover which forms on the top of the liquid bath and the anodes is primarily made up of alumina and cryolite. It is available in solid state and should be crushed and passed through a screen to obtain a powder which can be used to cover a spent anode. It has been noted that the powder resulting from crushing the cover has a high confinement capacity, which, in addition to its availability, make it a preferred option.

It is also possible to obtain powder 5 from electrolysis bath taken from an electrolysis cell and solidified into an ingot. This is also a compound which is available in a plant producing liquid aluminum. The bath in ingot form is reduced to powder, for example, by crushing followed by calibrating.

Other powders are possible, in particular ones containing silica. Powder 5 may incorporate sand in part or in full.

When anode 2 has cooled sufficiently, powder 5 is advantageously recovered, processed and recycled. The crushed bath is also a material which can be recycled in the plant and be used for various applications. It is generally stored in a silo acting as a general reserve in the plant.

A first embodiment of support 1 is shown in FIGS. 4 to 7.

Figure 4:
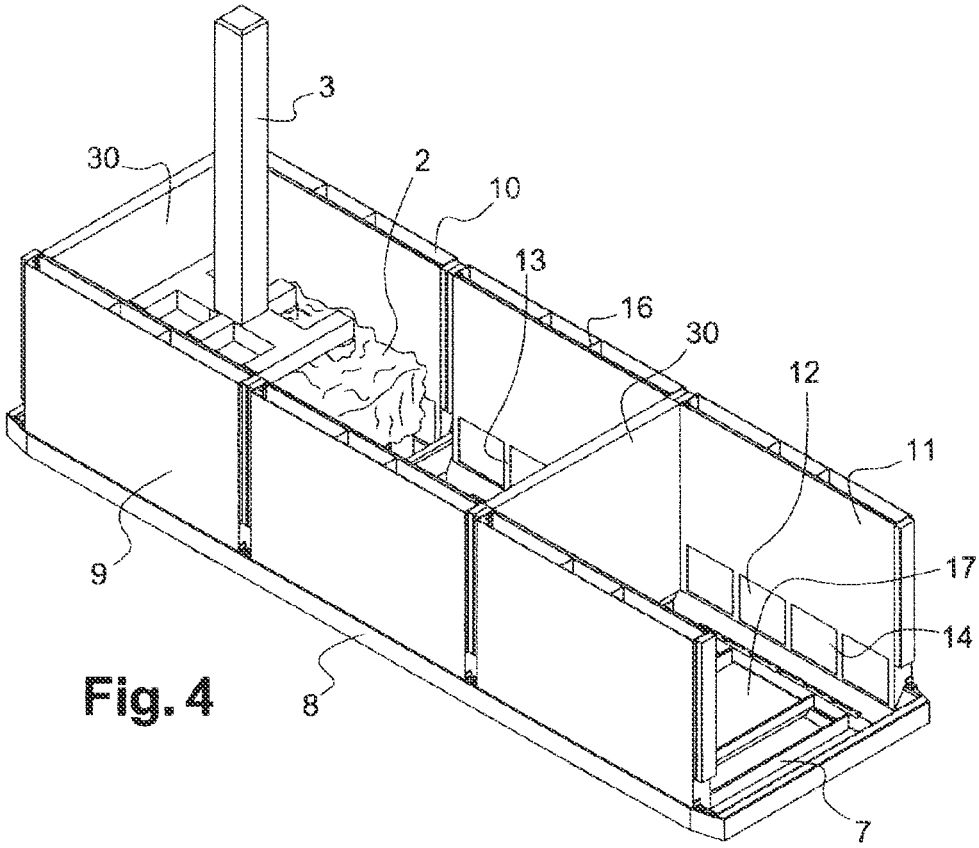
FIG. 4 is a perspective view of a support according to a first embodiment of the invention, an anode provided with its rod being placed on the support.

In this form of embodiment, support 1 includes a substantially horizontal plate 6, of generally rectangular shape, equipped with vertical ribs 7 which bound a compartment 17 in which anode 2 is to be placed. Support 1 has edges 8 on all or part of the sides of plate 6. Support 1 may be multi-compartment as shown in FIG. 4 which represents a support 1 which has three compartments 17.

According to the first embodiment of the invention, support 1 includes tanks 9 fitted onto plate 6, which are used to store powder 5 temporarily. Here, support 1 includes two tanks 9 placed on opposite sides of plate 6, each tank 9 extending over substantially the entire length of the corresponding side. Tanks 9 of supports 1 of the same unit are aligned along the large sides of said unit, as is seen in FIG. 4. During tests, it was noted that the amount of powder 5 necessary may range between 100 and 1,200 kg per anode, more typically between 300 and 1,000 kg, according to the size of the anodes, which depends on the technology under consideration. The quantity in kg of powder 5 necessary typically lies between 40% and 120% of the weight of the carbon in the spent anode and preferably ranging between 70% and 110% of the weight of the carbon in the spent anode.

Each tank 9 has substantially the shape of a right-angled parallelepiped. On its top face it has an opening 10 through which powder 5 can be introduced into said tank 9. For example, the entire top face of tank 9 is open. Preferably, this top face is covered with a lid (not shown) to avoid powder dispersing during movement of support 1. In a variant, the top face of tank 9 could have a smaller opening adapted to a powder supply device, which would prevent the dispersion of powder 5 when tanks 9 are filled.

Each tank 9 also has, on its internal face 11 facing the interior of support 1, an opening 12 for discharging powder 5 onto plate 6. Preferably, for greater efficiency, substantially all the length of each tank 9 comprises an opening 12 for discharging powder 5. In the embodiment shown in FIG. 4, the internal face 11 of tank 9 comprises several (here four) adjacent openings 12 separated by a very narrow wall 13 so as to maximize the powder outlet surface while ensuring the mechanical resistance of tank 9.

Each discharge opening 12 extends, along a vertical direction, from plate 6 to a height located above the anode when the latter is on plate 6, so that powder 5 when poured can cover spent anode 2 by limiting fly-off dust.

Each discharge opening 12 has a closing wall 14 which occupies a closed position when powder 5 is introduced into tank 9 through opening 10. Then, when an anode 2 is placed on support 1, the closing wall 14 is moved to an open position in order to discharge powder 5 contained in tank 9. The opening speed of the closing wall is advantageously controlled so as to keep fly-off dust to a minimum.

Having automatic or manual opening of closing wall 14 as soon as an anode 2 is on support 1 causes quick release of powder 5, thereby very quickly smothering anode 2 with powder 5. For this purpose, support 1 can be equipped with a temperature gauge (not shown) or any other means of detection—optical for example—which makes it possible to detect the presence of an anode 2 when the latter is very hot, and which controls an opening device of closing wall 14.

Tanks 9 are pre-filled by means of a device 20*a*, 20*b* for bringing the powder to support 1.

Figure 7:
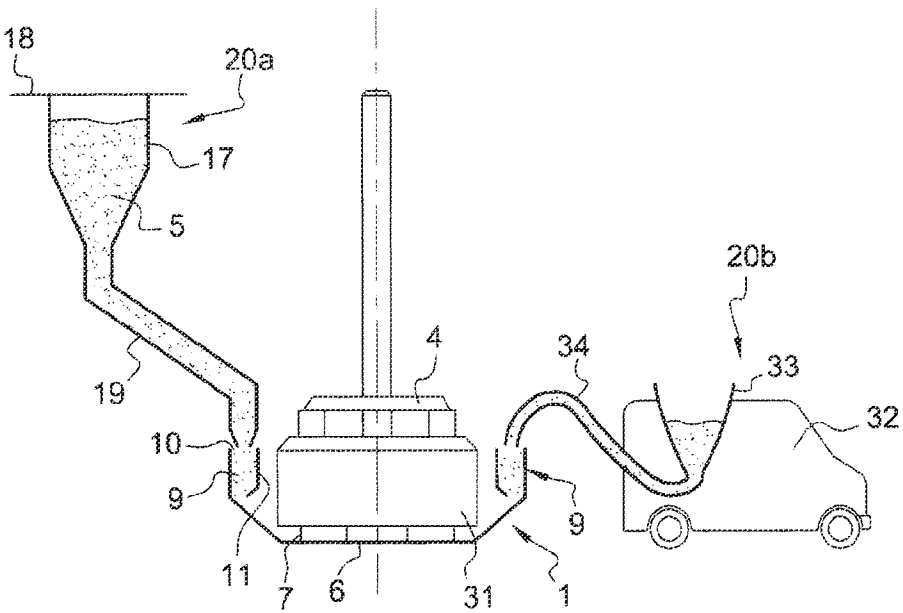
FIG. 7 is a schematic view of a first embodiment of a system according to the invention, including the support shown in FIG. 4 and a powder supply device.

According to a first possible embodiment, illustrated in FIG. 7, tanks 9 are pre-filled in a workshop separate from the hall where the electrolysis cells are, by means of a special dedicated powder supply device. In this workshop, a new anode 31 can be placed on support 1 and tanks 9 filled. Then support 1 carrying the new anode 31 is brought up to a cell comprising a spent anode which has to be replaced. New anode 31 can then be placed in said cell and spent anode 2 placed on support 1. Tanks 9 are then quickly opened so that the powder 5 that they contain is discharged around and onto spent anode 2.

In this first embodiment, the powder supply device 20*a* may comprise a hopper 17, possibly moving on an overhead traveling crane 18, and equipped with a powder 5 discharge conduit 19, as illustrated on the left of FIG. 7. In a variant, the powder supply device 20*b* may comprise a vehicle 32 carrying a container 33 of powder equipped with a hose 34 to fill tanks 9, as illustrated on the right-hand part of FIG. 7.

Tanks 9 make it possible to discharge powder 5 quickly, since the latter is already present and does not need to be brought along to support 1. So fluorinated gas emission can effectively be limited. In addition, these tanks 9 form means of confinement which considerably limit the dispersion of powder 5. Powder 5 is guided to slide along the internal walls and the bottom wall of tank 9.

Figure 5:
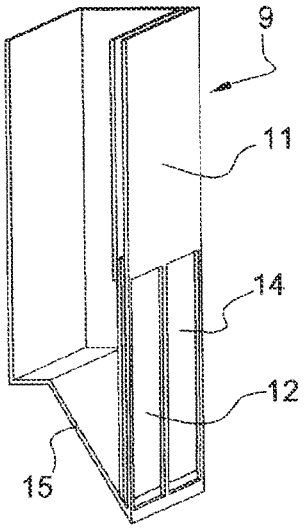
FIG. 5 is a detailed view of a tank pertaining to the support of FIG. 4, showing a powder discharge opening.

In order to guide, facilitate and accelerate the flow of powder 5, tanks 9 comprise a bottom wall 15 tilted downwards towards the interior of support 1, as is seen in FIG. 5.

Figure 6:
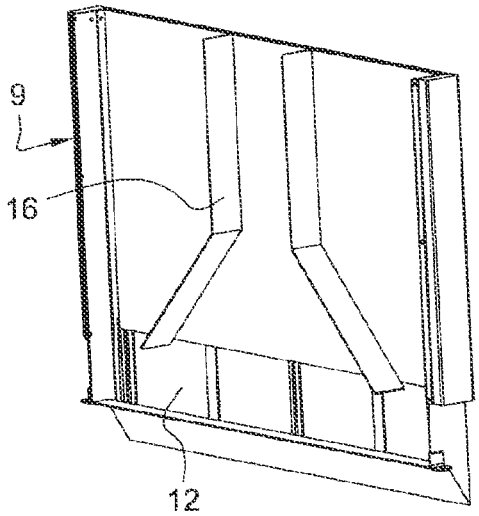
FIG. 6 is a detailed view of the support shown in FIG. 4, showing a tank equipped with internal means for distributing powder.

In addition, in order to fill tank 9 homogeneously, baffles 16, pipes or equivalent, forming means of distributing powder 5, may be provided inside tank 9 as illustrated in FIG. 6. This characteristic makes it possible to facilitate the subsequent flow of powder 5 towards the sides of anode 2.

The support may also include separators 30 to separate or bound the compartments and to limit the volume of the compartments. For reasons of visibility and clarity, only two separators 30 have been shown in FIG. 4. These separators 30 take part in the confinement of the powder in the compartments and may also act as powder tanks 9.

Figure 8:
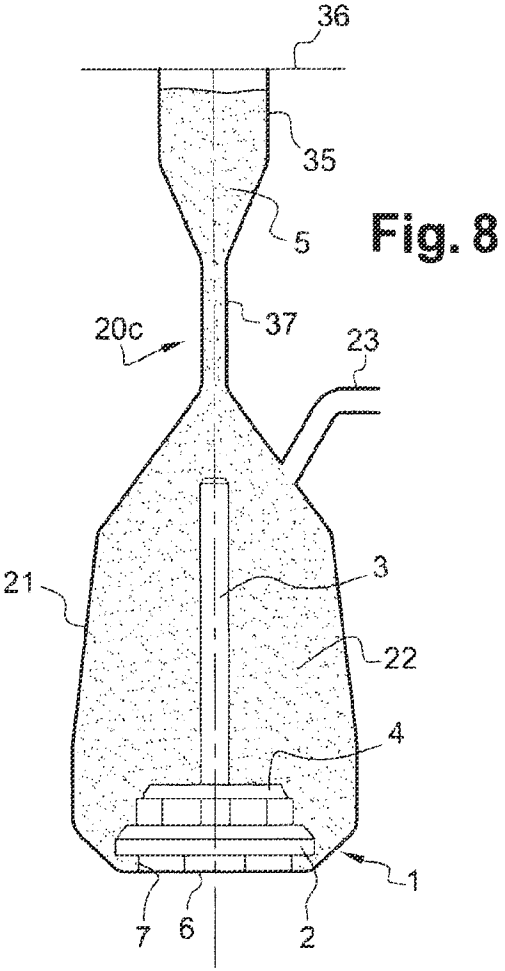
FIG. 8 is a schematic view of a second embodiment of a system according to the invention, including a temporary anode support and a powder supply device.

FIG. 8 illustrates a second embodiment of the invention.

Support 1 is similar to that shown in FIGS. 4 to 7 but here has no tanks 9.

Device 20*c* for bringing powder to support 1 includes a hopper 35 moving on an overhead traveling crane 36 and equipped with a powder 5 discharge conduit 37. Conduit 37 is extended at its lower part by a cover 21 which is substantially in the shape of a bell open downwards. Cover 21 has appropriate dimensions for capping spent anode 2 and rod 3 and to form with support 1 a confinement volume 22 for powder 5 discharged from hopper 35.

By means of cover 21, powder 5 can very quickly be poured onto anode 2—thereby limiting fluorinated gas emissions considerably—without the disadvantages related to a large dispersion of powder 5. In addition, powder supply device 20*c* may include a suction conduit 23 communicating with said confinement volume 22, in order to create a slightly negative pressure in said confinement volume 22.

It may of course be decided that support 1 should be as shown in FIGS. 4 to 7, i.e. it is additionally equipped with tanks 9.

An important point of the invention is that the powder is poured very quickly (in less than 5 minutes, and preferably in less than one minute) by mechanical means and then, possibly spread out manually by an operator over the anode. But it is attempted to limit human intervention because this takes time. In addition, long handling operations by an operator would present risks, because the operator would be in contact with fluorinated gases and with the powder itself. With the invention, this is limited since the fluorinated gas emissions are very quickly stopped and the tanks and/or the bell mean that there is very little powder fly-off. The invention therefore makes it possible to considerably reduce the risks for the operator.

The invention provides a key improvement to the former technique, in that it offers a process, a support and a system for the temporary storage of a spent anode which make it possible to effectively limit fluorinated gas emissions. During the 24 hours following the withdrawal of the anode from the cell, under a hood entirely covering the anode and the support receiving the anode, tests were carried out to measure the quantity of gas fluoride released into the atmosphere by the spent anode per ton of aluminum produced. These tests showed that covering the anode by means of a smothering powder deriving from recycling crushed bath cover with a particle size of less than 20 mm reduces the quantity of gas fluoride emitted by approximately 60% as compared to a spent anode left open to the air.

The invention also makes it possible to obtain better carbon management because it allows the combustion of the spent anode which is extracted from the electrolysis bath to be stopped quickly by preventing contact of the anode with the ambient air, thus preserving a maximum amount of healthy carbon. Also, an additional advantage of the invention is that it maximizes the amount of carbon which can be reprocessed, recycled and ultimately re-used for the manufacture of a carbon anode.

An important aspect of the invention is the fact that the smothering powder which ensure the confinement of the spent anode and of the pieces of bath cover which are attached to it is widely available in a plant producing primary aluminum.

It goes without saying that the invention is not limited to the embodiments described above by way of examples, but encompasses all embodiment variants.

The invention claimed is:

1. Process for changing a spent anode from an aluminum electrolysis cell including at least one anode plunged into an electrolysis bath and a bath cover covering the anode and the liquid bath, wherein the process includes stages consisting of:

removing a spent anode, to which pieces of bath cover are attached, from the electrolysis bath;

placing said spent anode on a support;

pouring a smothering powder onto said spent anode placed on the support to cover said spent anode with an aim in particular of limiting fluorinated gas emission.

2. Process according to claim 1, wherein the powder is selected from the group including alumina, substances comprising aluminum fluoride and/or sodium fluoride, such as cryolite, sand or a mixture of such substances.

3. Process according to claim 2, wherein the powder at least partly comprises bath cover reduced to powder.

4. Process according to claim 2, wherein the powder at least partly comprises electrolysis bath reduced to powder after solidification.

5. Process according to claim 1, wherein at least one tank associated functionally with support is pre-filled with powder and in that said at least one tank is opened when a spent anode is on the support.

6. Process according to claim 1, wherein means of discharging the powder onto the spent anode on the support are provided, said means of discharging comprising means of confinement able to limit the dispersion of the powder.

7. Process according to claim 6, wherein the means of confinement are arranged on the support or a device for supplying powder to the support.

8. Process according to claim 1, additionally including transporting of the spent anode placed on the support and covered with smothering powder to a spent anode reprocessing plant.

* * * * *